US011071320B2

(12) United States Patent
Martha et al.

(10) Patent No.: US 11,071,320 B2
(45) Date of Patent: Jul. 27, 2021

(54) SMOKING ARTICLE FILTER FOR EASY EXTINGUISHING

(71) Applicant: PHILIP MORRIS PRODUCTS S.A., Neuchatel (CH)

(72) Inventors: Martha Martha, Surabaya (ID); Nicolas Cusnir, Lausanne (CH); Alen Kadiric, Orpund (CH); Charles Kuersteiner, Jouxtens-Mezery (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/900,832

(22) PCT Filed: Feb. 13, 2014

(86) PCT No.: PCT/EP2014/052854
§ 371 (c)(1),
(2) Date: Dec. 22, 2015

(87) PCT Pub. No.: WO2015/007399
PCT Pub. Date: Jan. 22, 2015

(65) Prior Publication Data

US 2016/0192699 A1 Jul. 7, 2016

(30) Foreign Application Priority Data

Jul. 16, 2013 (EP) ..... 13176746

(51) Int. Cl.
*A24D 3/04* (2006.01)
*A24D 1/02* (2006.01)

(52) U.S. Cl.
CPC ..... *A24D 3/04* (2013.01); *A24D 1/02* (2013.01); *A24D 1/027* (2013.01); *A24D 3/043* (2013.01)

(58) Field of Classification Search
CPC ..... A24D 3/043; A24D 1/02
(Continued)

(56) References Cited

U.S. PATENT DOCUMENTS 2,269,995 A * 1/1942 Trane ..... A24D 1/027 131/336
3,744,496 A * 7/1973 McCarty ..... A24B 15/12 131/342

(Continued)

FOREIGN PATENT DOCUMENTS

CA 2300715 9/2000
CN 1282546 2/2001

(Continued)

OTHER PUBLICATIONS

Office Action issued in Singapore for Application No. 11201600199W dated Sep. 26, 2016 (6 pages).

(Continued)

*Primary Examiner* — Eric Yaary
*Assistant Examiner* — Russell E Sparks
(74) *Attorney, Agent, or Firm* — Mueting Raasch Group

(57) ABSTRACT

There is provided a smoking article comprising a tobacco rod, a filter and tipping material attaching the tobacco rod and the filter. The filter comprises a plug of filtration material that defines a furthest downstream end of the smoking article, the plug being surrounded by one or more filter wrappers. The tipping material includes a ventilation zone. The tipping material and the filter wrapper or wrappers have a combined thickness (t) perpendicular to the longitudinal direction of the smoking article, and the smoking article, at a location about the plug of filtration material, has a diameter (D SA) perpendicular to the longitudinal direction of the smoking article. The diameter (D SA) to thickness (t) ratio (Continued)

is less than about 80 and the filtration material extends to the furthest downstream end of the smoking article.

8 Claims, 1 Drawing Sheet

(58) Field of Classification Search
USPC ..... 131/336
See application file for complete search history.

(56) References Cited

U.S. PATENT DOCUMENTS

| | | | | | |
|---|---|---|---|---|---|
| 4,174,719 | A * | 11/1979 | Martin | A24D 3/043 | 131/336 |
| 4,207,458 | A * | 6/1980 | Lilly, Jr. | A24C 5/007 | 219/384 |
| 4,578,053 | A * | 3/1986 | Luke | A24D 3/04 | 493/43 |
| 4,587,982 | A * | 5/1986 | Adams | A24D 3/043 | 131/336 |
| 4,700,726 | A * | 10/1987 | Townsend | A24D 1/00 | 131/360 |
| 4,915,117 | A * | 4/1990 | Ito | C04B 35/80 | 131/349 |
| 4,920,990 | A * | 5/1990 | Lawrence | A24B 15/14 | 131/359 |
| 5,365,951 | A * | 11/1994 | Arterbery | A24D 3/04 | 131/336 |
| 5,839,449 | A * | 11/1998 | Banerjee | A24D 3/043 | 131/342 |
| 6,718,989 | B1 | 4/2004 | Clarke | | |
| 6,883,524 | B2 | 4/2005 | Ishikawa | | |
| 9,510,621 | B2 * | 12/2016 | Ono | A24C 5/472 | |
| 2002/0002979 | A1 | 1/2002 | Bowen | | |
| 2002/0053350 | A1 * | 5/2002 | Tani | A24D 1/02 | 131/360 |
| 2007/0157940 | A1 | 7/2007 | Mua | | |
| 2008/0314399 | A1 * | 12/2008 | Ricketts | A24D 1/00 | 131/331 |
| 2010/0108081 | A1 * | 5/2010 | Blevins Joyce | A24B 15/282 | 131/274 |
| 2010/0288293 | A1 | 11/2010 | Jordil | | |
| 2011/0180088 | A1 * | 7/2011 | Hooper | A24C 5/56 | 131/365 |
| 2012/0000477 | A1 * | 1/2012 | Sebastian | A24D 1/02 | 131/329 |
| 2013/0239983 | A1 * | 9/2013 | Burke | A24D 3/062 | 131/332 |
| 2015/0181929 | A1 * | 7/2015 | Lisan | A24D 3/043 | 131/332 |

FOREIGN PATENT DOCUMENTS

| | | | | |
|---|---|---|---|---|
| CN | 102715656 | | 10/2012 | |
| CN | 202664222 | | 1/2013 | |
| EP | 1098036 | | 5/2001 | |
| EP | 2002737 | | 12/2008 | |
| EP | 2229827 | | 9/2010 | |
| JP | 62-86894 | | 6/1987 | |
| JP | 2012-507287 | | 3/2012 | |
| KR | 2012-0042761 | | 5/2012 | |
| KR | 2013/0035670 | | 4/2013 | |
| RU | 2197876 | | 2/2003 | |
| RU | 2255163 | | 6/2005 | |
| WO | WO 2009/109433 | | 9/2009 | |
| WO | WO-2012049880 | A1 * | 4/2012 | A24C 5/472 |
| WO | WO-2013034652 | A1 * | 3/2013 | A24D 3/045 |

OTHER PUBLICATIONS

European Extended Search Report for Application No. 13176746.9 dated Jan. 14, 2015 (5 pages).
Bradford et al., "Elastic Local Buckling of Thin-Walled Elliptical Tubes Containing Elastic Infill Material", *Interaction and Multiscale Mechanics*, vol. 1, No. 1 (2007) 143-156.
Kim et al., "Buckling Strength of the Cylindrical Shell and Tank Subjected to Axially Compressive Loads", *Thin-Walled Structures*, 40 (2002) 329-353.
"Buckling Thin-Walled Circular Cylinders", NASA Space Vehicle Design [Structures], NASA SP-8007, Sep. 1965, revised Aug. 1968.
PCT Search Report for PCT/EP2014/052854 dated Jun. 10, 2014 (4 pages).
Office Action issued in Japan for Application No. 2016-526470 dated Oct. 16, 2017 (6 pages). English translation included.
Office Action issued in Russia for Application No. 2016104875 dated Feb. 9, 2018 (6 pages). English translation included.
Office Action issued in China for Application No. 201480036390.6 dated Aug. 29, 2018 (19 pages). English translation included.
Office Action issued in China for Application No. 201480036390.6 dated Aug. 1, 2019 (8 pages). English translation included.
Office Action issued in Korea for Application No. 10-2015-7035735 dated 4, 2020 (15 pages). English translation included.

* cited by examiner

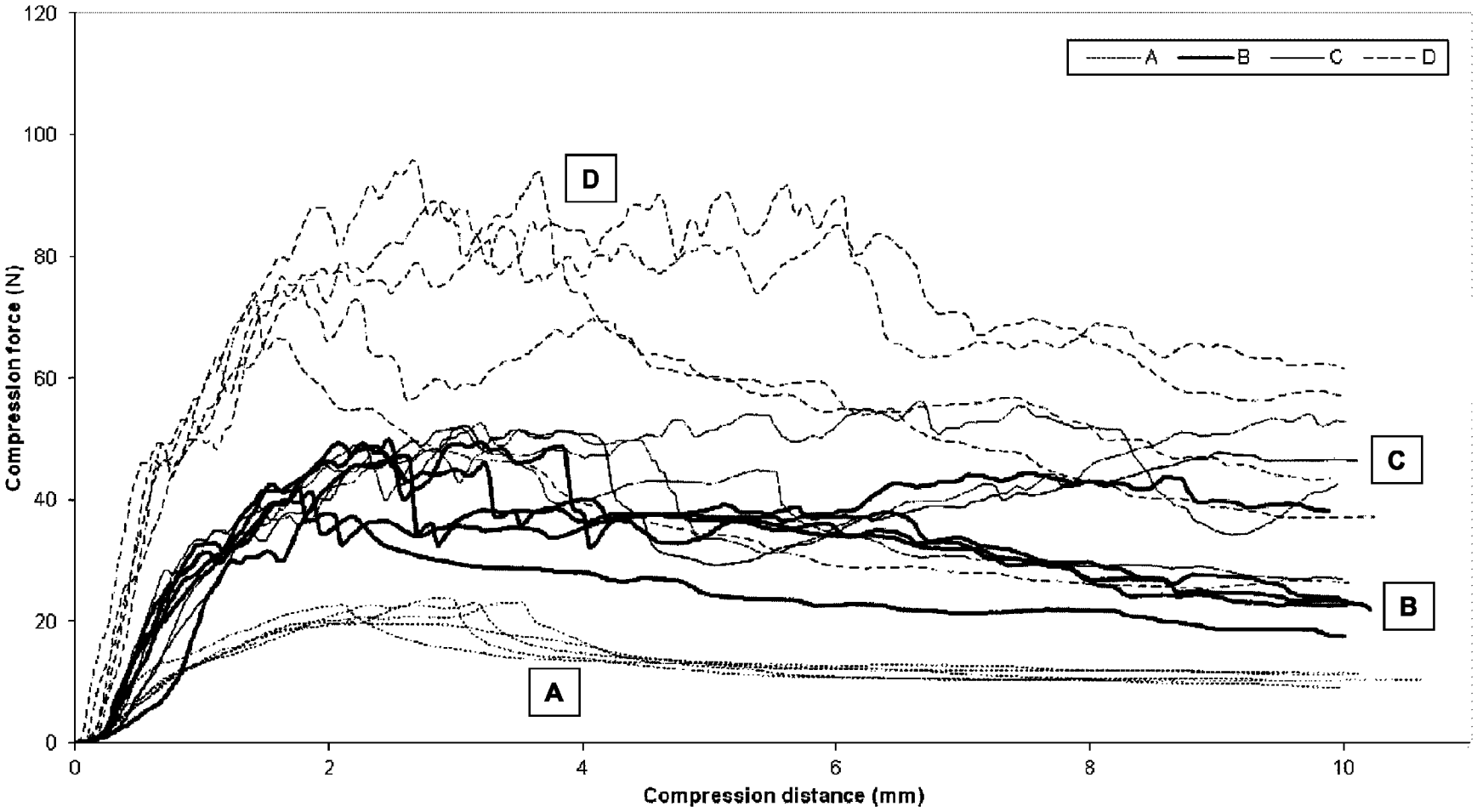
A
B
C
D
Compression force (N)
Compression distance (mm)
0
20
40
60
80
100
120
0
2
4
6
8
10

SMOKING ARTICLE FILTER FOR EASY EXTINGUISHING

This application is a U.S. National Stage Application of International Application No. PCT/EP2014/052854, filed Feb. 13, 2014, which was published in English on Jan. 22, 2015 as International Patent Publication WO 2015/007399 A1. International Application No. PCT/EP2014/052854 claims priority to European Application No. 13176746.9 filed Jul. 16, 2013.

The present invention relates to a filter for a smoking article, and a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

Smoking articles, particularly cigarettes, generally comprise a filter aligned in end-to-end relationship with the tobacco rod or other aerosol forming substrate. Typically, the filter includes a plug of cellulose acetate tow wrapped in a filter wrapper. The filter is generally attached to the tobacco rod or substrate by tipping paper which overlies the filter and an adjacent portion of the tobacco rod.

It is often desirable to ventilate a filter to dilute the mainstream smoke. Ventilation of mainstream smoke can be achieved with a row or rows of perforations in the tipping paper about a location along the filter. Where ventilation is provided, porous filter wrappers without any perforations are known. In such a case, the ventilation level can be controlled solely by the perforations in the tipping paper, and the tipping paper may be pre-perforated before the smoking article is assembled. However, porous filter wrappers tend to be structurally weak and may also be difficult to manufacture.

Generally, a consumer smokes the cigarette until the burning area of the tobacco rod reaches the edge of the tipping paper. This means that a small portion of the tobacco (where the tipping paper overlaps the tobacco rod) still remains unburnt and will continue to burn unless extinguished. Therefore, the consumer extinguishes the cigarette, typically by holding the filter and pressing the lit end of the cigarette against the base of an ashtray or other hard non-flammable surface. This disrupts the structure of the lit end and prevents oxygen reaching the burning tobacco, and burning usually stops rapidly. However, in the process of extinguishing the cigarette, the consumer's fingers may come into contact with, or close to, the lit end of the cigarette or old ash remaining in the ashtray.

It would therefore be desirable to provide a filter for a smoking article which provides a more safe and hygienic way to extinguish the smoking article after smoking.

According to a first aspect of the invention, there is provided a smoking article comprising: a tobacco rod; a filter comprising a plug of filtration material that defines a furthest downstream end of the smoking article, the plug being surrounded by one or more filter wrappers; and tipping material attaching the tobacco rod and the filter, the tipping material including a ventilation zone; wherein the tipping material and the filter wrapper or wrappers have a combined thickness (t) perpendicular to the longitudinal direction of the smoking article; wherein the smoking article, at a location about the plug of filtration material, has a diameter ($D_{SA}$) perpendicular to the longitudinal direction of the smoking article; wherein the diameter ($D_{SA}$) to thickness (t) ratio is less than about 80; wherein the filtration material extends to the furthest downstream end of the smoking article; wherein the ventilation zone comprises perforations through the tipping material; and wherein the perforations extend through the one or more filter wrappers.

Analysis of the buckling strength of various cylindrical structures has been performed, but this has generally been in the fields of construction and aeronautics, where the envisaged compressive loads are very high. In addition, the analysis has generally considered cylindrical shells, and little work has involved shells which are filled or partially filled with material which may interact with the cylindrical shell. This buckling strength has not yet been fully assessed for filters for smoking articles, and modelling such an effect is notoriously difficult. However, the inventors of the present invention have observed that, for a given filter height, the buckling strength or critical load of the smoking article filter may be considerably increased by decreasing the ratio of $D_{SA}$:t relative to standard filter cigarettes. This allows the smoking article to be extinguished by a consumer while considerably reducing the chance of the filter buckling under the compressive load.

In addition, the filtration material of the filter plug extends to the furthest downstream end, a mouth end, of the smoking article. That is, the mouth end of the filter is filled and does not form a cavity, recess or hollow mouth end. This may provide additional strength which may further increase the critical load. This may avoid the need for a very thick tipping material or filter wrapper (which may be more difficult to roll around the plug of filtration material) while still reducing the chance of buckling during extinguishing. Moreover, typically a consumer will want to hold the smoking article at the extreme downstream end during extinguishing, in order to minimise the chance of the consumer's fingers coming into contact with the lit end of the cigarette or old ash remaining in the ashtray. Because the filtration material extends to the furthest downstream end, the filter will resist collapse caused by the radial force (pincer action) of the consumer's fingers on the mouth end. This, in turn provides improved stability for the filter during extinguishing.

By providing a diameter ($D_{SA}$) to thickness (t) ratio less than about 80 and providing filtration material extending to the mouth end, the critical load of the smoking article filter can be increased. This reduces the chances of the filter buckling during extinguishing which, in turn, reduces the chances that the consumer's fingers come into contact with the lit end of the cigarette or old ash remaining in the ashtray. This also reduces the chance of a consumer burning his or her fingers during the extinguishing process. For a diameter ($D_{SA}$) to thickness (t) ratio less than about 80, critical loads at least twice as high as in standard filter cigarettes have been observed.

The tipping material includes a ventilation zone at a location about the filter. The ventilation zone comprises perforations through the tipping material. The perforations extend through the filter wrapper or wrappers. Although the perforations weaken the filter structure, certain properties of the filter, such as the level of ventilation, may be selected to ensure the critical load of the filter remains sufficiently large to reduce the chance of the filter buckling during the extinguishing process. One such property is the porosity of the one or more filter wrappers.

In particular, preferably, the one or more filter wrappers have low porosity. Preferably, the one or more filter wrappers have a porosity of less than about 1000 Coresta units, more preferably less than about 500 Coresta units, and even more preferably less than about 100 Coresta units. The porosity may be as low as 100 Coresta units. In addition, or in the alternative, the porosity may be more than about 1 Coresta unit. Such low porosity filter wrappers may help to improve the strength of the filter, and may help to increase the critical load of the smoking article. This can be particularly beneficial given that perforations extend through the tipping paper and one or more filter wrappers.

The tipping material may be standard pre-perforated tipping material. Preferably, however, the tipping material is perforated (for example, using a laser) during the manufacturing process according to the desired number, size and position of the perforations.

The amount of ventilation provided by the perforations may be selected to provide the desired level of ventilation and to ensure a desired buckling strength for the filter. Whilst some ventilation is necessary, too much ventilation may lower the critical load beyond a desired range.

In a preferred embodiment, the ventilation zone provides at least about 10% ventilation of the mainstream smoke. Alternatively, the ventilation zone may provide at least about 20% ventilation of the mainstream smoke.

In a preferred embodiment, the ventilation zone provides less than about 80% ventilation of the mainstream smoke. It has been found that beyond this level of ventilation, the critical load of the filter can become lower than desired. Alternatively, the ventilation zone may provide less than about 70% ventilation of the mainstream smoke.

The number of rows of perforations may be selected to provide the desired level of ventilation and to ensure a sufficiently high buckling strength for the filter. One or two rows of perforations are typically provided. However, up to 7 lines of perforations may be provided in some embodiments.

The position of the perforations may be selected to provide the desired level of ventilation and to ensure a sufficiently high buckling strength for the filter. Preferably, the perforations are at least 9 mm from the mouth end (furthest downstream end) of the filter. Preferably, the perforations are at least 6 mm from the tobacco rod.

The size and shape of the perforations may also be selected to provide the desired level of ventilation and to ensure a sufficiently high buckling strength for the filter.

The terms "buckling strength" and "critical load" are used interchangeably in this specification to refer to the axial compressive load on the smoking article filter at which the filter will collapse or buckle.

In this specification, the terms "upstream" and "downstream" are used to describe relative positions between elements of the filter or smoking article in relation to the direction of mainstream smoke as it is drawn from a lit end of the smoking article through the filter. Mainstream smoke flows generally parallel to the length of the smoking article, in the longitudinal direction. The transverse direction of the smoking article is perpendicular to the longitudinal direction.

The one or more filter wrappers may comprise any suitable material or combination of materials. Examples of suitable materials include, but are not limited to, cellulose based materials, paper, cardboard, recon, cellulose based film, and combinations thereof. The one or more filter wrappers may be printed, embossed, debossed or otherwise embellished with manufacturer or brand logos, trade marks, slogans and other consumer information and indicia. Preferably, however, the one or more filter wrappers comprise paper.

Generally, one filter wrapper is provided around the plug of filtration material, although a greater number of filter wrappers is possible. It may be advantageous for the small diameter ($D_{SA}$) to thickness (t) ratio in the smoking article according to the invention to be primarily provided by the one or more filter wrappers, rather than by the tipping material. This will prevent the need for particularly thick tipping material. This may allow the ventilation zone to be formed in the tipping material straightforwardly. This may also allow the tipping material to be easily curved around the smoking article during manufacture, to attach the tobacco rod and filter.

Accordingly, preferably, the one or more filter wrappers have a bending stiffness of at least about 0.08 N in the machine direction of the filter wrapper.

The one or more filter wrappers may have a bending stiffness less than about 0.2 N in the machine direction of the filter wrapper. The machine direction of the filter wrapper preferably corresponds to the transverse direction of the smoking article.

Preferably, the one or more filter wrappers have a bending stiffness of at least about 0.04 N in the cross direction of the filter wrapper.

The one or more filter wrappers may have a bending stiffness less than about 0.1 N in the cross direction of the filter wrapper. The cross direction of the filter wrapper preferably corresponds to the longitudinal direction of the smoking article.

The term "bending stiffness" used in this specification refers to the resistance of the material to a bending force applied perpendicular to the plain of the material. The bending stiffness may be determined by International Organization for Standardization (ISO) test ISO 5628:2012.

If more than one filter wrapper is provided, the total bending stiffness in a given direction of the one or more filter wrappers is the combined bending stiffness of each of the filter wrappers.

As already discussed, it may be advantageous for the small diameter ($D_{SA}$) to thickness (t) ratio in the smoking article according to the invention to be primarily provided by the one or more filter wrappers, rather than by the tipping material. Accordingly, preferably, the one or more filter wrappers have a basis weight greater than about 50 grams per square metre ($gm^{-2}$). It has been found that this provides a desired critical load. Preferably, the one or more filter wrappers have a basis weight less than about 100 $gm^{-2}$. It has been noted that there is minimal gain in critical load of the filter beyond this value. It is therefore advantageous to limit the basis weight to about this value, since the filter wrapper is then easier to handle. More preferably, the one or more filter wrappers have a basis weight between about 65 $gm^{-2}$ and about 85 $gm^{-2}$. Even more preferably, the one or more filter wrappers have a basis weight between about 70 $gm^{-2}$ and about 80 $gm^{-2}$. In preferred embodiments, a single filter wrapper is provided and this single filter wrapper has a basis weight as set out above. Alternatively, in some embodiments, multiple filter wrappers may be provided, and the combined basis weight of the multiple wrappers may be the basis weight as set out above.

The diameter ($D_{SA}$) is the total diameter of the plug of filtration material together with the tipping material and the filter wrapper or wrappers. The diameter ($D_{SA}$) is measured at a location about the plug of filtration material so may be thought of as the diameter of the filter portion of the smoking article. The diameter ($D_{SA}$) is measured substantially perpendicular to the longitudinal direction of the smoking article and filter. As long as the diameter ($D_{SA}$) to thickness (t) ratio is less than about 80, the diameter ($D_{SA}$) may have any suitable value. However, it may be convenient for the diameter ($D_{SA}$) to be substantially the same as in conventional smoking articles.

Any suitable smoking article diameter ($D_{SA}$) may be selected. However, preferably the diameter ($D_{SA}$) is between about 7.0 mm and about 8.0 mm, more preferably about 7.8 mm, even more preferably about 7.84 mm. The diameter ($D_{SA}$) may be about 7.0 mm. These diameters typically correspond to larger sized smoking articles, which may be particularly susceptible to buckling as the smoking article is extinguished.

In a preferred embodiment, the diameter ($D_{SA}$) to thickness (t) ratio is greater than about 50. If $D_{SA}/t$>about 50, the thickness (t) is still sufficiently small that the tipping material and the filter wrapper or wrappers may be straightforwardly rolled or curved around the plug of filtration material.

The thickness (t) is the combined thickness of the tipping material and the filter wrapper or wrappers. The thickness (t) is measured substantially perpendicular to the longitudinal direction of the smoking article and filter. As long as the diameter ($D_{SA}$) to thickness (t) ratio is less than about 80, the thickness (t) may have any suitable value. However, because it may be convenient for the diameter ($D_{SA}$) to be substantially the same as in conventional smoking articles, in such cases the thickness (t) is greater than in conventional smoking articles.

The thickness (t) may be between about 100 μm and about 160 μm.

Preferably, the filter wrapper or wrappers have a (combined, if more than one wrapper is provided) thickness ($t_1$) substantially perpendicular to the longitudinal direction of the smoking article. The thickness of the tipping material substantially perpendicular to the longitudinal direction of the smoking article may be designated $t_2$.

Preferably, the filter wrapper or wrappers have a thickness ($t_1$) substantially perpendicular to the longitudinal direction of the smoking article, wherein $t_1/t$ is greater than about 0.65.

As already discussed, it may be advantageous for the small diameter ($D_{SA}$) to thickness (t) ratio in the smoking article according to the invention to be primarily provided by the one or more filter wrappers, rather than by the tipping material.

The thickness ($t_1$) of the one or more filter wrappers may be between about 90 μm and about 120 μm, preferably about 100 μm. The thickness ($t_2$) of the tipping material may be between about 30 μm and about 70 μm, preferably about 40 μm.

In one preferred embodiment, $t_1/t$ is about 0.75. For example, if the thickness (t) is about 120 μm, $t_1$ may be about 90 μm and $t_2$ may be about 30 μm. In another preferred embodiment, $t_1/t$ is about 0.71. For example, if the thickness (t) is about 140 μm, $t_1$ may be about 100 μm and $t_2$ may be about 40 μm.

Preferably, the filter has a height (H) substantially parallel to the longitudinal direction of the filter. The height (H) designates the total height of the filter, including the plug of filtration material. That is, if the filter comprises one or more filter segments in addition to the plug of filtration material, the height (H) is the total height of all the filter segments and the plug of filtration material. If the filter comprises only the plug of filtration material, the height (H) is the height of only the plug of filtration material.

Preferably, the filter has a height (H) between about 15 mm and about 40 mm. Even more preferably, the filter has a height (H) between about 18 mm and about 27 mm. In one embodiment, the filter has a height (H) of about 27 mm. In another embodiment, the filter has a height (H) of about 21 mm.

The filtration material may comprise any suitable material or combination of materials. The type of filtration material may be selected to provide the desired level of RTD during smoking and the desired level of strength during extinguishing. Examples of suitable materials include, but are not limited to, cellulose acetate, cellulose, reconstituted cellulose, polylactic acid, polyvinyl alcohol, nylon, polyhydroxybutyrate, thermoplastic material, such as starch, non-woven materials, longitudinally oriented fibres and randomly oriented fibres, crepe, PLA fibres, and combinations thereof. One or more of the materials may be formed into an open cell structure. All or part of the filter may include activated carbon or other sorbent material. The filter may include an adhesive or plasticiser or a combination thereof. The filtration material may be compressible. In preferred embodiments, the filtration material comprises cellulose acetate.

The filtration material may have any suitable denier per filament (dpf) and total denier (td). Generally, the filtration material selected may have a denier per filament, total denier and total density similar to that of filtration materials in conventional smoking articles.

The tipping material may comprise any suitable material or combination of materials. Examples of suitable materials include, but are not limited to, cellulose based materials, paper, cardboard, recon, cellulose based film, and combinations thereof. The tipping material may be printed, embossed, debossed or otherwise embellished with manufacturer or brand logos, trade marks, slogans and other consumer information and indicia. Preferably, however, the tipping material comprises paper.

Preferably, the smoking article has a filter section having a critical load of at least about 30 Newtons, more preferably at least about 40 Newtons, when subjected to the test of unsmoked smoking articles set out below in respect of FIG. 1, referred to as Test A. Preferably, the smoking article has a filter section having a critical load of less than about 80 Newtons, more preferably less than about 60 Newtons, when subjected to the test set out unsmoked smoking articles below in respect of FIG. 1, referred to as Test A.

Preferably, the filter comprises filtration material extending along the whole length of the filter. Preferably, this is in the form of a single segment filter. That is to say, preferably, the only filter segment in the filter is the plug of filtration material. Preferably, no additional filter segments are provided either upstream or downstream of the plug of filtration material.

Alternatively, as long as the filtration material of the filter plug, extends to the mouth end of the smoking article, the filter may include one or more additional filter elements upstream of the plug of filtration material. Thus, exemplary filter structures that may be used include, but are not limited to, a mono filter, a dual filter, a triple filter, a single or multi cavity filter, and combinations thereof.

If the filter comprises a multi component filter comprising a plurality of filter segments, the one or more filter wrappers may surround one, some or all of the filter segments. Preferably, each filter segment comprises a respective filter wrapper and the whole filter is surrounded by a further filter wrapper.

If the filter comprises a multi component filter comprising a plurality of filter segments, the tipping material may surround all the filter segments plus the adjacent portion of the tobacco rod. Alternatively, the tipping material may surround only a portion of the filter, plus the adjacent portion of the tobacco rod.

The tobacco rod may comprise any suitable type or types of tobacco material or tobacco substitute, in any suitable form.

According to a second aspect of the invention, there is provided a filter for a smoking article, the filter comprising: a plug of filtration material that defines a furthest downstream end of the filter; one or more filter wrappers surrounding the plug of filtration material; wherein the one or more filter wrappers have a combined wrapper thickness ($t_1$) perpendicular to the longitudinal direction of the filter; wherein the filter has a diameter ($D_F$) perpendicular to the longitudinal direction of the filter; wherein the filter diameter ($D_F$) to wrapper thickness ($t_1$) ratio is less than about 135; wherein the filtration material extends to the furthest downstream end of the filter; and wherein the filter comprises perforations extending through the one or more filter wrappers.

By providing a filter diameter ($D_F$) to wrapper thickness ($t_1$) ratio less than about 135 and providing filtration material extending to the filter mouth end, the critical load of the smoking article filter can be increased. This reduces the chances of the filter buckling during extinguishing which, in turn, reduces the chances that the consumer's fingers come into contact with the lit end of the cigarette or old ash remaining in the ashtray. The $D_F$:$t_1$ ratio of 135 corresponds to a $D_{SA}$:t ratio of 100, where the diameter of the filter ($D_{SA}$)=7.84 mm and the tipping material thickness ($t_2$)=40 μm.

As discussed in relation to the first aspect of the invention, the one or more filter wrappers may comprise any suitable material or combination of materials.

In a preferred embodiment, the one or more filter wrappers have a bending stiffness of at least about 0.08 N in the machine direction of the filter wrapper. The one or more filter wrappers may have a bending stiffness less than about 0.2 N in the machine direction of the filter wrapper. The machine direction of the filter wrapper preferably corresponds to the transverse direction of the filter.

In a preferred embodiment, the one or more filter wrappers have a bending stiffness of at least 0.04 N in the cross direction of the filter wrapper. The one or more filter wrappers may have a bending stiffness less than about 0.1 N in the cross direction of the filter wrapper. The cross direction of the filter wrapper preferably corresponds to the longitudinal direction of the filter.

As already discussed in relation to the first aspect of the invention, the total bending stiffness in a given direction of the one or more filter wrappers is the combined bending stiffness of each of the filter wrappers.

Preferably, the one or more filter wrappers have a basis weight greater than about 50 grams per square metre ($gm^{-2}$). Preferably, the one or more filter wrappers have a basis weight less than about 100 $gm^{-2}$. More preferably, the one or more filter wrappers have a basis weight between about 65 $gm^{-2}$ and about 85 $gm^{-2}$. Even more preferably, the one or more filter wrappers have a basis weight between about 70 $gm^{-2}$ and about 80 $gm^{-2}$. In preferred embodiments, a single filter wrapper is provided and this single filter wrapper has a basis weight as set out above. Alternatively, in some embodiments, multiple filter wrappers may be provided, and the combined basis weight of the multiple wrappers may be the basis weight as set out above.

The filter diameter ($D_F$) is the total diameter of the plug of filtration material together with the filter wrapper or wrappers. The diameter ($D_{SA}$) of the smoking article comprises the diameter ($D_F$) of the filter plus the tipping material. The filter diameter ($D_F$) is measured substantially perpendicular to the longitudinal direction of the filter. As long as the filter diameter ($D_F$) to wrapper thickness ($t_1$) ratio is less than about 135, the filter diameter ($D_F$) may have any suitable value. However, it may be convenient for the filter diameter ($D_F$) to be substantially the same as in conventional smoking articles.

In a preferred embodiment, the filter diameter ($D_F$) to wrapper thickness ($t_1$) ratio is greater than about 70.

The thickness ($t_1$) of the one or more filter wrappers may be between about 90 μm and about 120 μm.

Preferably, the filter has a height (H) substantially parallel to the longitudinal direction of the filter. The height (H) designates the total height of the filter, including the plug of filtration material. That is, if the filter comprises one or more filter segments in addition to the plug of filtration material, the height (H) is the total height of all the filter segments and the plug of filtration material. If the filter comprises only the plug of filtration material, the height (H) is the height of only the plug of filtration material.

Preferably, the filter has a height (H) between about 15 mm and about 40 mm. Even more preferably, the filter has a height (H) between about 18 mm and about 27 mm. In one embodiment, the filter has a height (H) of about 27 mm. In another embodiment, the filter has a height (H) of about 21 mm.

As discussed in relation to the first aspect of the invention, the filtration material may comprise any suitable material or combination of materials. The filtration material may have any suitable denier per filament (dpf) and total denier (td).

Preferably, the filter comprises filtration material extending along the whole length of the filter. Preferably, this is in the form of a single segment filter. That is to say, preferably, the only filter segment in the filter is the plug of filtration material. Preferably, no additional filter segments are provided either upstream or downstream of the plug of filtration material.

Alternatively, as long as the filtration material of the filter plug, extends to the mouth end of the filter, the filter may include one or more additional filter elements upstream of the plug of filtration material.

Filters according to the present invention may advantageously be used in filter cigarettes and other smoking articles in which tobacco material is combusted to form smoke.

According to a third aspect, the invention is directed to use of a filter, or a method of using a filter, in a smoking article to reduce chance of buckling during extinguishing of the smoking article, the filter comprising: a plug of filtration material that defines a furthest downstream end of the smoking article; one or more filter wrappers surrounding the plug of filtration material; wherein the one or more filter wrappers have a combined wrapper thickness ($t_1$) perpendicular to the longitudinal direction of the filter; wherein the filter has a diameter ($D_F$) perpendicular to the longitudinal direction of the filter; wherein the filter diameter ($D_F$) to wrapper thickness ($t_1$) ratio is less than about 135; wherein the filtration material extends to the furthest downstream end of the smoking article; and wherein the filter comprises perforations extending through the one or more filter wrappers.

Features and advantages described in relation to one aspect of the invention may also be applicable to another aspect of the invention.

The invention will be further described, by way of example only, with reference to the accompanying drawings in which:

FIG. 1 illustrates a graph of compression force (N) against compression distance (mm) for five samples of four types of smoking article.

The inventors of the present invention have noted that, without ventilation, smoking article filters may not buckle. The filters may simply reduce in size steadily with increasing compression force. However, when ventilation is provided, the structure of the filter may be weakened. Unfortunately, this weakened filter structure may buckle during extinguishing. This may mean that the consumer's fingers come into contact with, or close to, the lit end of the cigarette or old ash remaining in the ashtray.

However, as discussed previously, the inventors of the present invention have observed that, for a given filter height, the buckling strength or critical load of the smoking article filter may be considerably increased by decreasing the ratio of $D_{SA}$:t relative to standard filter cigarettes. This allows the smoking article to be extinguished by a consumer while considerably reducing the chance of the filter buckling under the compressive load.

The relationship between $D_{SA}$:t and critical load was tested using a force gauge obtained from Alluris GmbH & Co KG, Freiburg, Germany. Unsmoked filters were tested by first removing the tobacco rod and upstream portion of the tipping paper surrounding the tobacco rod, and then applying the required force in Newtons (N) to compress the filter by a preselected distance in millimetres (mm) at a particular compression speed (mm $min^{-1}$). Smoked filters were tested by first removing any unburnt tobacco and tipping paper upstream of the filter, and then applying the required force in Newtons (N) to compress the filter by a preselected distance in millimetres (mm) at a particular compression speed (mm $min^{-1}$). The values of compression force and compression distance were recorded (in this case for a compression speed of 100 mm $min^{-1}$).

FIG. 1 is a graph of compression force (N) against compression distance (mm) for five samples of four types of smoking article. The four types of (unsmoked) smoking article filters tested (using the above described apparatus) were:

Filter Type A: Cigarette filters having a diameter ($D_{SA}$) to thickness (t) ratio of about 98 ($D_{SA}$=7.84 mm, t=80 μm ($t_1$=40 μm, $t_2$=40 μm)). The filter height (H) is 27 mm and the basis weight of the filter wrapper is about 26 $gm^{-2}$. Data for these filters are shown in dotted lines.

Filter Type B: Filters according to the invention, having a diameter ($D_{SA}$) to thickness (t) ratio of about 56 ($D_{SA}$=7.84 mm, t=140 μm ($t_1$=100 μm, $t_2$=40 μm)) and 80% ventilation. The filter height (H) is 27 mm and the basis weight of the filter wrapper is about 78 $gm^{-2}$. Data for these filters are shown in thick solid lines.

Filter Type C: Filters according to the invention, having a diameter ($D_{SA}$) to thickness (t) ratio of about 56 ($D_{SA}$=7.84 mm, t=140 μm ($t_1$=100 μm, $t_2$=40 μm)) and 10% ventilation. The filter height (H) is 27 mm and the basis weight of the filter wrapper is about 78 $gm^{-2}$. Data for these filters are shown in thin solid lines.

Filter Type D: Cigarette filters having a diameter ($D_{SA}$) to thickness (t) ratio of about 44 ($D_{SA}$=7.84 mm, t=180 μm ($t_1$=140 μm, $t_2$=40 μm)). The filter height (H) is 27 mm and the basis weight of the filter wrapper is about 110 $gm^{-2}$. Data for these filters are shown in dashed lines.

As can be seen most clearly from the dashed lines for Filter Type D, as the compression distance increases, at a particular point, the required compression force drops suddenly. This is the moment of buckling. So, the maximum compression force reached at the point of buckling corresponds to the critical load.

For the five samples of Filter Type A (dotted lines), the mean critical load was found to be 22.46 N. For the five samples of the filters according to the invention, with 80% ventilation, (Filter Type B, thick solid lines), the mean critical load was found to be 45.94 N. For the five samples of the filters according to the invention, with 10% ventilation, (Filter Type C thin solid lines), the mean critical load was found to be 52.92 N. For the five samples of Filter Type D (dashed lines), the mean critical load was found to be 85.22 N. Thus, FIG. 1 shows that, as the $D_{SA}$/t ratio decreases (from 98 to 56 to 44), the critical load of the filter increases. This in turn reduces the chances of buckling. The filters according to the invention represent a balance between a sufficiently high critical load, while still using filter wrappers which are relatively easy to handle.

Interestingly, it has also been noted by the inventors that the approximate value of the critical load for Filter Type C (a filter according to the invention, having a diameter ($D_{SA}$) to thickness (t) ratio of about 56, with 10% ventilation) after smoking is of the order of 20 N or slightly greater. To simulate the smoking of a smoking article, the smoking article is subjected to a standard smoking test under ISO conditions (35 ml puffs lasting 2 seconds each, with puffs occurring once every 60 seconds) as set out in ISO 4387: 2000. In the ISO test method, the smoking article is smoked with the ventilation zone fully uncovered. Such a value of critical load may be advantageous, since the force exerted by a consumer during the extinguishing process may be up to about this value. Thus, this may represent a particularly advantageous balance between a sufficiently high critical load, while still using filter wrappers which are relatively easy to handle.

FIG. 1 also shows that there is a difference in critical load depending on the level of ventilation. Two types of filter according to the invention were tested (using the above mentioned apparatus): one with 10% ventilation and the other with 80% ventilation. As already mentioned, for the filter according to the invention having 10% ventilation, the mean critical load was found to be 52.92 N. For the filter according to the invention having 80% ventilation, the mean critical load was found to be 45.94 N. Thus, the critical load decreases with increased levels of ventilation.

Thus, the smoking articles and filters according to the invention provide for: reduced chances of buckling during extinguishing; a filter plug wrap which has sufficiently high critical load but is also thin enough to be relatively easy to handle, and critical loads during extinguishing which may correspond to an upper limit of forces typically exerted by consumer during extinguishing.

The invention claimed is:

1. A smoking article comprising: a tobacco rod; a filter comprising a plug of filtration material that defines a furthest downstream end of the smoking article, the plug being surrounded by one or more filter wrappers, wherein the combined thickness of the one or more filter wrappers is between 90 microns and 120 microns; and tipping material attaching the tobacco rod and the filter, the tipping material including a ventilation zone, the thickness of the tipping material being between 30 microns and 70 microns; wherein the tipping material and the filter wrapper or wrappers have a combined thickness (t) perpendicular to the longitudinal direction of the smoking article; wherein the smoking article, at a location about the plug of filtration material, has a diameter ($D_{SA}$) perpendicular to the longitudinal direction of the smoking article; wherein the diameter ($D_{SA}$) to thickness (t) ratio is greater than 50 and less than 80; wherein the filtration material extends to the furthest downstream end of the smoking article; wherein the ventilation zone comprises perforations through the tipping material; wherein the perforations extend through the one or more filter wrappers; wherein the one or more filter wrappers have a porosity of less than about 500 CORESTA units; wherein the one or more filter wrappers have a basis weight between about 65 grams per square meter and about 85 grams per square meter, and wherein the filter has a critical load from 30 Newtons to 80 Newtons.

2. The smoking article according to claim 1, wherein the ventilation zone provides between about 10% and about 80% ventilation of the mainstream smoke.

3. The smoking article according to claim 1, wherein the filter wrapper or wrappers have a thickness ($t_1$) substantially perpendicular to the longitudinal direction of the smoking article, wherein $t_1/t$ is greater than about 0.65.

4. The smoking article according to claim 1, wherein the tipping material and the one or more filter wrappers have a combined thickness (t) of between about 100 microns and about 160 microns.

5. The smoking article according to claim 1, wherein the smoking article has a filter section that, when removed from the tobacco rod and tipping material of an unsmoked smoking article, has a critical load of at least about 30 Newtons when subjected to a compressive force at a compression speed of 100 mm per mi n.

6. A filter for a smoking article, the filter comprising a plug of filtration material that defines a furthest downstream end of the smoking article, the plug being surrounded by one or more filter wrappers, wherein the combined thickness of the one or more filter wrappers is between 90 microns and 120 microns; and tipping material attaching the tobacco rod and the filter, the tipping material including a ventilation zone, the thickness of the tipping material being between 30 microns and 70 microns; wherein the tipping material and the filter wrapper or wrappers have a combined thickness (t) perpendicular to the longitudinal direction of the smoking article; wherein the smoking article, at a location about the plug of filtration material, has a diameter ($D_{SA}$) perpendicular to the longitudinal direction of the smoking article; wherein the diameter ($D_{SA}$) to thickness (t) ratio is greater than 50 and less than 80; wherein the filtration material extends to the furthest downstream end of the smoking article; wherein the ventilation zone comprises perforations through the tipping material; wherein the perforations extend through the one or more filter wrappers; wherein the one or more filter wrappers have a porosity of less than about 500 CORESTA units; wherein the one or more filter wrappers have a basis weight between about 65 grams per square meter and about 85 grams per square meter, and wherein the filter has a critical load from 30 Newtons to 80 Newtons.

7. The filter according to claim 6, wherein the filter diameter ($D_F$) to wrapper thickness ($t_1$) ratio is greater than about 70.

8. A method of reducing buckling during extinguishing of the smoking article, the method comprising providing a plug of filtration material that defines a furthest downstream end of the smoking article, the plug being surrounded by one or more filter wrappers, wherein the combined thickness of the one or more filter wrappers is between 90 microns and 120 microns; and tipping material attaching the tobacco rod and the filter, the tipping material including a ventilation zone, the thickness of the tipping material being between 30 microns and 70 microns; wherein the tipping material and the filter wrapper or wrappers have a combined thickness (t) perpendicular to the longitudinal direction of the smoking article; wherein the smoking article, at a location about the plug of filtration material, has a diameter ($D_{SA}$) perpendicular to the longitudinal direction of the smoking article; wherein the diameter ($D_{SA}$) to thickness (t) ratio is greater than 50 and less than 80; wherein the filtration material extends to the furthest downstream end of the smoking article; wherein the ventilation zone comprises perforations through the tipping material; wherein the perforations extend through the one or more filter wrappers; wherein the one or more filter wrappers have a porosity of less than about 500 CORESTA units; wherein the one or more filter wrappers have a basis weight between about 65 grams per square meter and about 85 grams per square meter, and wherein the filter has a critical load from 30 Newtons to 80 Newtons.

* * * * *